US008904696B2

(12) United States Patent
Geller

(10) Patent No.: US 8,904,696 B2
(45) Date of Patent: Dec. 9, 2014

(54) DEVICE FOR FAST RETICLE ADJUSTMENT OF A SIGHTING DEVICE

(71) Applicant: Leica Camera AG, Solms (DE)

(72) Inventor: Reiner Geller, Wetzlar (DE)

(73) Assignee: Leica Camera AG, Solms (DE)

( * ) Notice: Subject to any disclaimer, the term of this patent is extended or adjusted under 35 U.S.C. 154(b) by 85 days.

(21) Appl. No.: 13/786,021

(22) Filed: Mar. 5, 2013

(65) Prior Publication Data

US 2013/0312310 A1 Nov. 28, 2013

(30) Foreign Application Priority Data

Mar. 6, 2012 (DE) ..... 10 2012 004 209
Oct. 9, 2012 (DE) ..... 10 2012 109 608

(51) Int. Cl.
*F41G 1/38* (2006.01)

(52) U.S. Cl.
CPC ..... *F41G 1/38* (2013.01)
USPC ..... 42/122; 42/130; 42/135; 74/504; 356/252

(58) Field of Classification Search
CPC ..... F41G 1/38; F41G 1/16; F41G 1/18; F41G 1/387; F41G 1/44; F41G 1/54; F41G 1/545; G05G 1/10
USPC ..... 42/122, 130, 135; 356/252
See application file for complete search history.

(56) References Cited

U.S. PATENT DOCUMENTS

| | | | | |
|---|---|---|---|---|
| 1,939,540 | A * | 12/1933 | Charvet | 89/200 |
| 2,833,158 | A | 5/1958 | Damon | |
| 2,913,826 | A * | 11/1959 | Petty | 42/122 |
| 3,990,155 | A * | 11/1976 | Akin et al. | 42/122 |
| 7,578,091 | B2 * | 8/2009 | Klepp et al. | 42/122 |
| 7,640,830 | B2 | 1/2010 | Bonis | |
| 7,934,335 | B2 * | 5/2011 | Halverson | 42/137 |
| 7,997,163 | B2 * | 8/2011 | Casas | 74/553 |
| 8,413,364 | B2 * | 4/2013 | Riley | 42/122 |
| 8,713,843 | B2 * | 5/2014 | Windauer | 42/113 |
| 2006/0278035 | A1 * | 12/2006 | Casas | 74/553 |
| 2008/0066364 | A1 * | 3/2008 | Klepp et al. | 42/122 |
| 2008/0236018 | A1 * | 10/2008 | Halverson | 42/135 |
| 2011/0102918 | A1 * | 5/2011 | Windauer | 359/821 |
| 2012/0147488 | A1 * | 6/2012 | Riley | 359/811 |

FOREIGN PATENT DOCUMENTS

DE 20 2006 003 770 U1 7/2006

* cited by examiner

*Primary Examiner* — Samir Abdosh
(74) *Attorney, Agent, or Firm* — Foley & Lardner LLP

(57) ABSTRACT

A device for fast reticle adjustment of a sighting device is described, which is provided with a rotatable safeguard against unintended adjustment and has tactile and visual indicating means for the locked and unlocked position of the safeguard.

10 Claims, 5 Drawing Sheets

DEVICE FOR FAST RETICLE ADJUSTMENT OF A SIGHTING DEVICE

Figure 1:
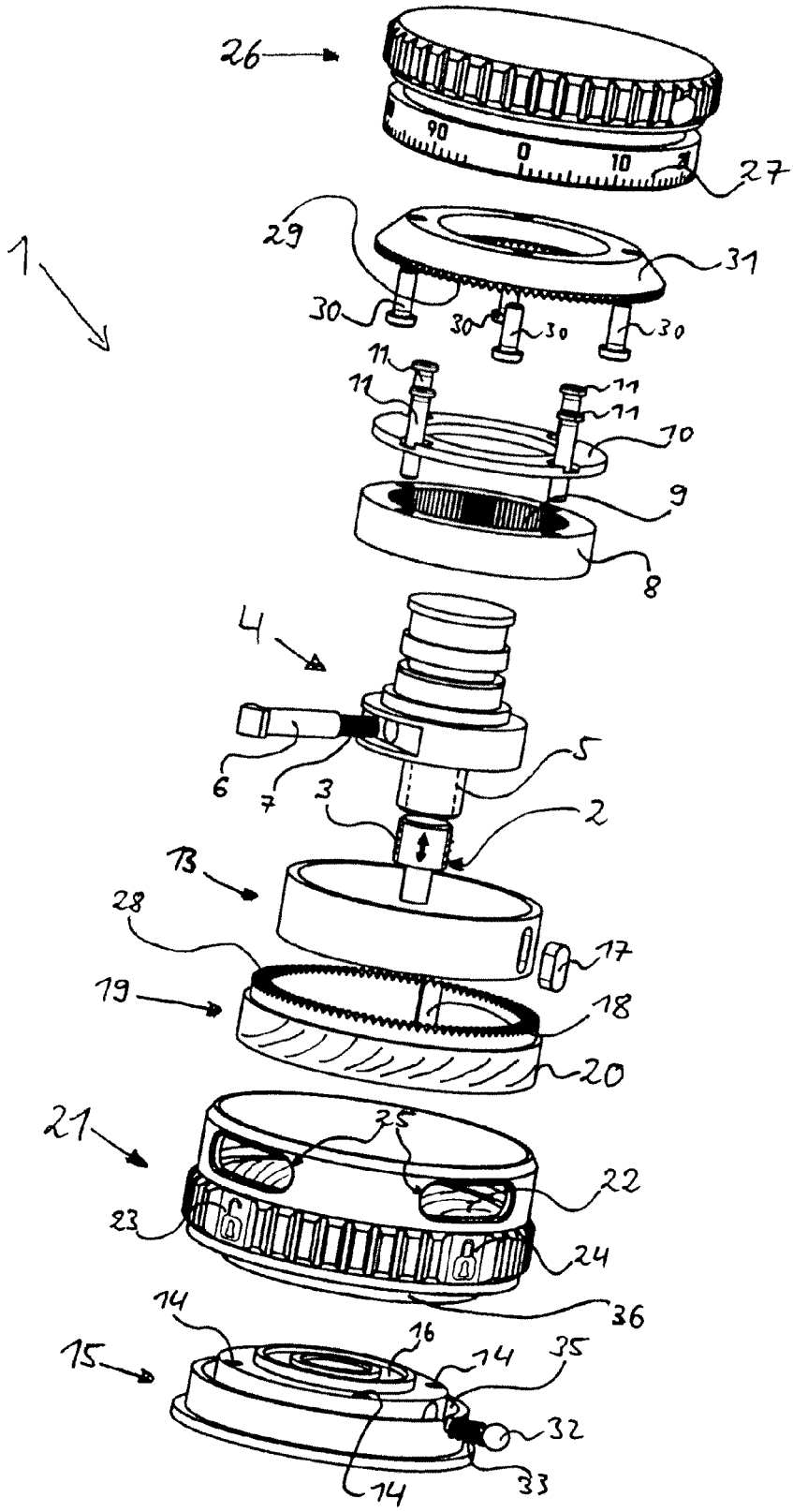

The invention relates to a device for fast reticle adjustment according to the preamble of patent claim 1.

Fast reticle adjustments are known in the field of telescopic sights and are used to take account of the different ballistic behavior of the ammunition which is to be fired with a weapon as a function of the distance to the sighted target. The target mark (the reticle) of the telescopic sight in conjunction with the weapon is usually preset to a specific ammunition used by the marksman and to a standard distance. In the case in which the target is located at the standard distance (normally 100 m), the marksman sights the target with the aid of the reticle without having to perform any further settings. However, if the target is located nearer or further than this standard distance or if other ammunition with other ballistic characteristics is used, then the marksman must take this into account during sighting and before discharging the shot and aim appropriately higher or lower. A further possible way to take account of this deviation is to compensate for these influences, for example, with a fast reticle adjustment, which usually acts directly on the reversal system pivotably mounted in the telescopic sight. Here, the target mark is corrected by a correction value in the vertical position and the marksman can then sight the target with the aid of the reticle despite the deviation from the standard distance and/or standard ammunition. In order to adjust the reticle, it is usual to use rotary drives which have a click detent. In the case of such click detents, a defined vertical adjustment is effected with the aid of a detent ring. For instance, one click changes the point of impact by 1 cm at 100 m.

The disadvantage with the known fast reticle adjustments is, however, that these are also unintentionally adjusted rapidly and erroneous settings which the user does not notice are possible.

For this reason, fast reticle adjustments are often secured against unintended adjustment by various methods.

Such a fast reticle adjustment secured against unintended adjustment is known, for example from U.S. Pat. No. 7,997,163. There, an unintended erroneous setting is prevented in that, before any setting of the reticle, a protective cap which protects the adjustment head of the fast reticle adjustment against unintended activation must be raised in order to expose the adjusting wheel of the fast reticle adjustment. The setting of the reticle is performed by a conventional click detent. Then, in order to secure the adjusting knob of the fast reticle adjustment, the protective cap has to be locked on again.

DE 20 2006 003 770 U1 describes a further solution to the problem of unintended adjustment. In this fast reticle adjustment, a safeguard is achieved in that the setting knob acting on the reticle has to be raised against the restoring force of a spring for the purpose of adjustment. In the raised position, rotation of the setting knob effects an adjustment of the reticle. The overall length of the adjustment drive changes disadvantageously in the process and, as a result of the pulling action, pulling pressure with respect to the weapon is likewise built up and the holding and target point are changed. The parts moved counter to tension and pressure exhibit wear and, after a specific time of use, mechanical interfaces can become leaky, which is undesired, since telescopic sights are designed to be water-tight and dust-tight. Leaks permit a nitrogen filling that is often present to escape from the interior.

It is an object of the invention to avoid the indicated disadvantages in the prior art and to implement a low-wear, simple fast reticle adjustment that manages with few moving components and which can be operated without any additional tool.

A further object of the invention is to improve a safeguard against unintended adjustment further and to permit a compact adjusting mechanism without any change in the overall length or the removal of any kind of protective caps in the event of setting the reticle.

According to the invention, these objects are achieved by a device having the characterizing features of patent claim 1. Advantageous developments and embodiments form the subject matter of the sub-claims.

In a first embodiment of the invention, in a device for fast reticle adjustment of a sighting device of a telescopic sight in which, with the aid of a rotatably mounted setting knob, an actuating drive mounted such that it can be displaced in the axial direction acts on the adjusting unit of the sighting device, the setting knob is provided with a safeguard against unintended adjustment that can be rotated through 90°. For the purpose of easy operability and perception of the setting for the user, the safeguard has tactile and visual indicating means for a locked position and an unlocked position of the safeguard. By means of separating the setting functions and the locking function, the construction of the device is simplified and erroneous operations are avoided. The setting knob has knurling on the outside and forms the upper end of the device.

Advantageously, the ability of the safeguard and of the chosen setting to be identified by touch is improved by the safeguard being formed by a control wheel with integrally molded knurling. In a particularly advantageous development, the control wheel can have a larger external diameter as compared with the setting knob for the improved ability to be identified by touch. An external diameter of the control wheel that is larger by at least 3 mm as compared with the diameter of the setting knob is advantageous; the diameter of the setting knob can be matched to that of the central tube, specifically, for example, 31 mm. For the tactile indication of the locked and unlocked positions, arranged offset by 90°, the control wheel has detent torques that can be felt. A ball detent has proven to be particularly worthwhile, in which a ball resting against an inner running surface of the control wheel under spring tension latches into a groove on the inside of the control wheel in a manner that can be felt in the respective end positions, namely the locked and unlocked position. The control wheel has detent grooves offset through 90° arranged on the inside. In this way, operation in the dark and at twilight is also possible, and the safeguard and the control wheel can be distinguished from the setting knob visually and by touch.

In a particular refinement, the invention can also be used for lateral reticle adjustment. In such an application, in the position of use of the telescopic sight, the device is arranged laterally on the left or right as a further adjustment tower. In this case, the control wheel has additional visual marks in the form of the letters L and R beside one of the window-like openings. In the unlocked setting of the control wheel, the user can carry out a left-hand correction of the shot deviation with a rotation in the L direction and a right-hand correction with a rotation in the R direction. As a result of the L and R mark, the user is given an unmistakable visual indication as to the direction in which he makes the correction. Apart from the window-like opening in the locked setting, no identifications are provided, so that in this way erroneous operation and, on account of the locking, unintended adjustments are additionally likewise avoided.

An exemplary embodiment of the invention is illustrated schematically in the drawing and will be explained in more detail below by using the figures.

Figure 2A:
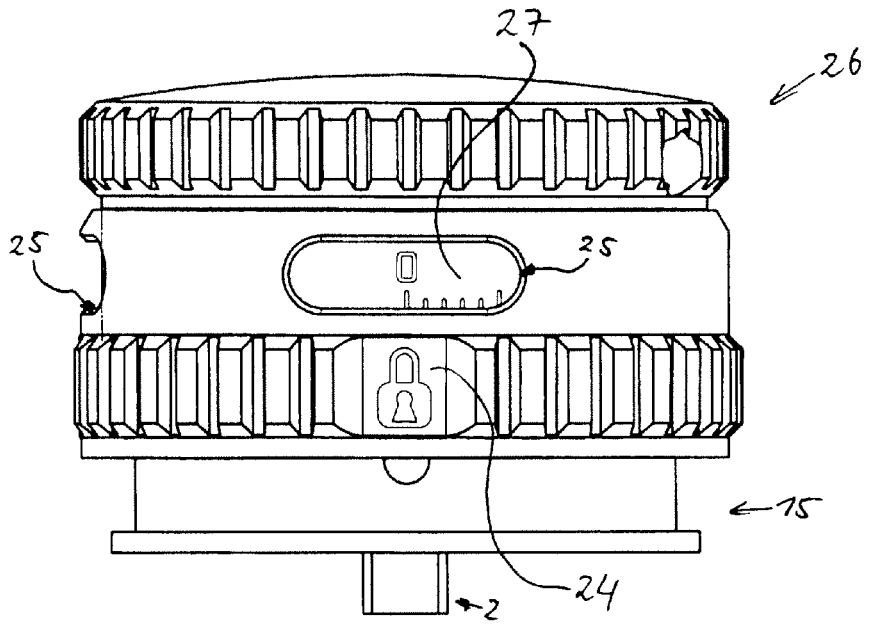
Figure 2B:
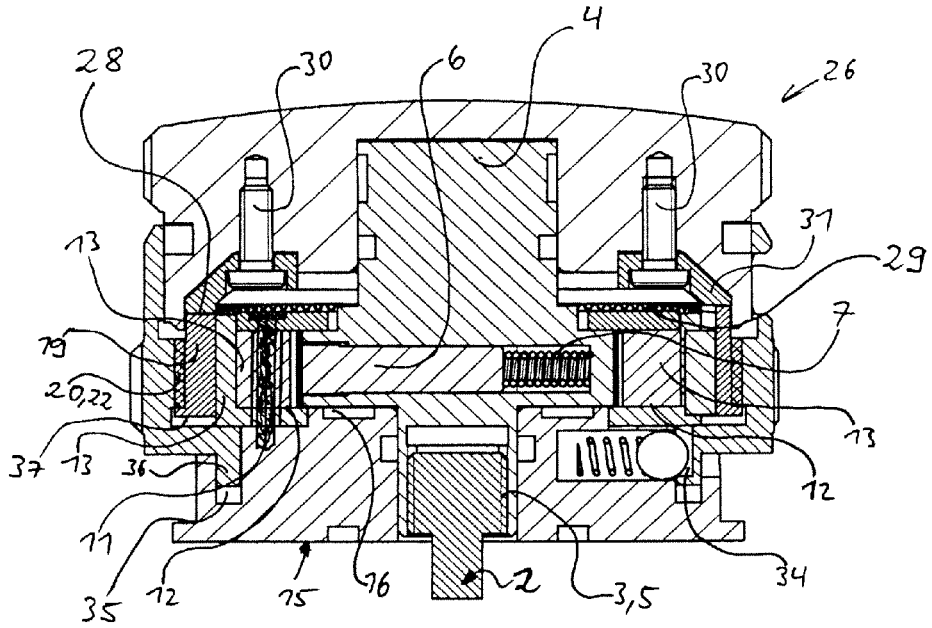
Figure 3A:
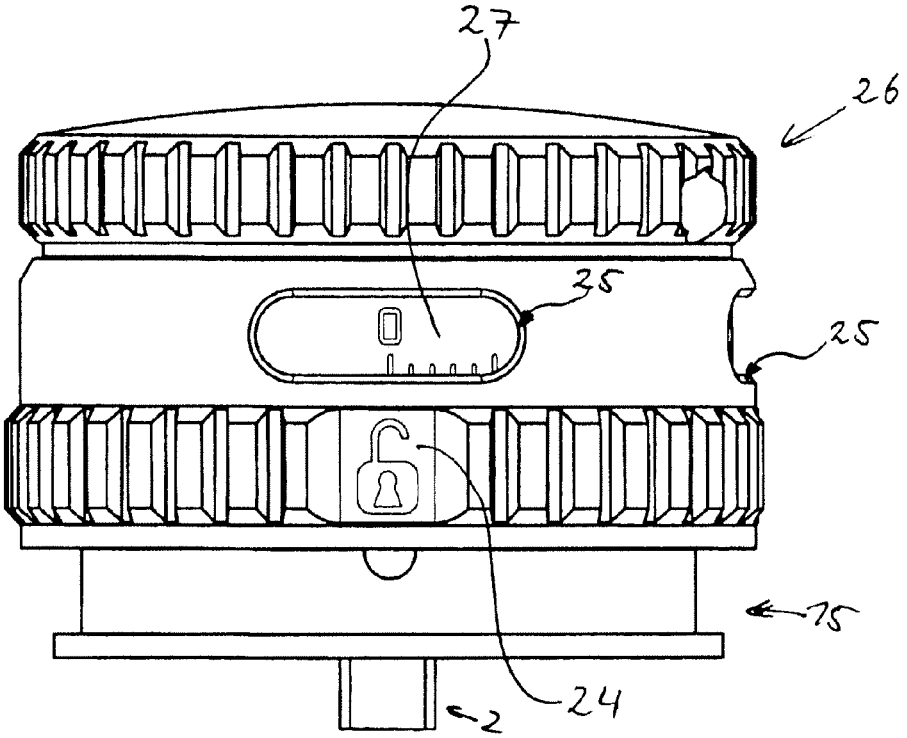
Figure 3B:
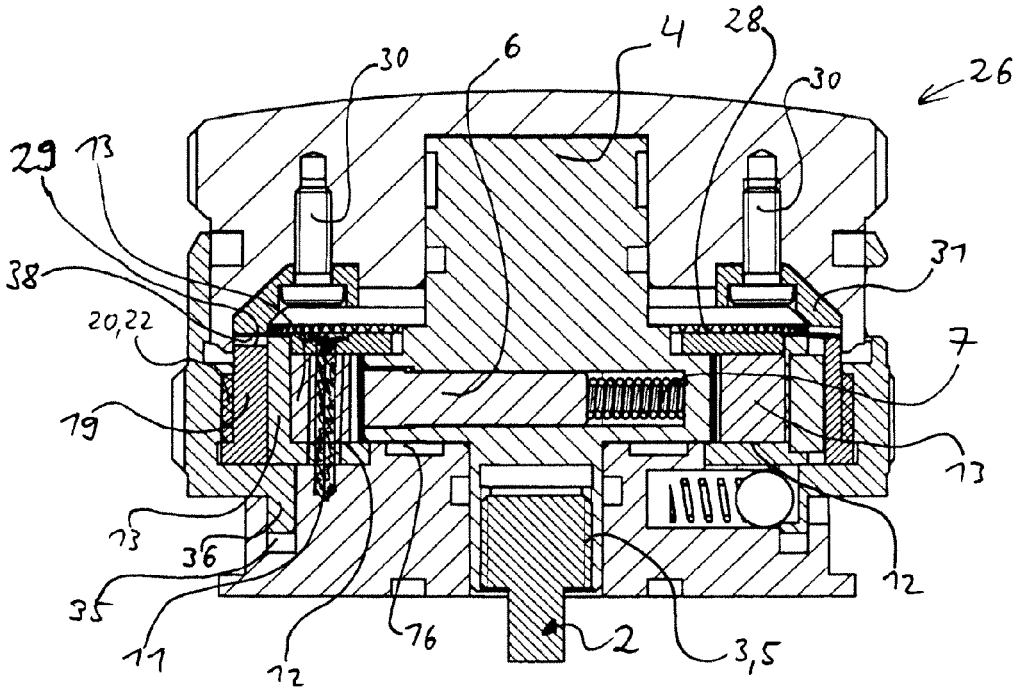
Figure 4A:
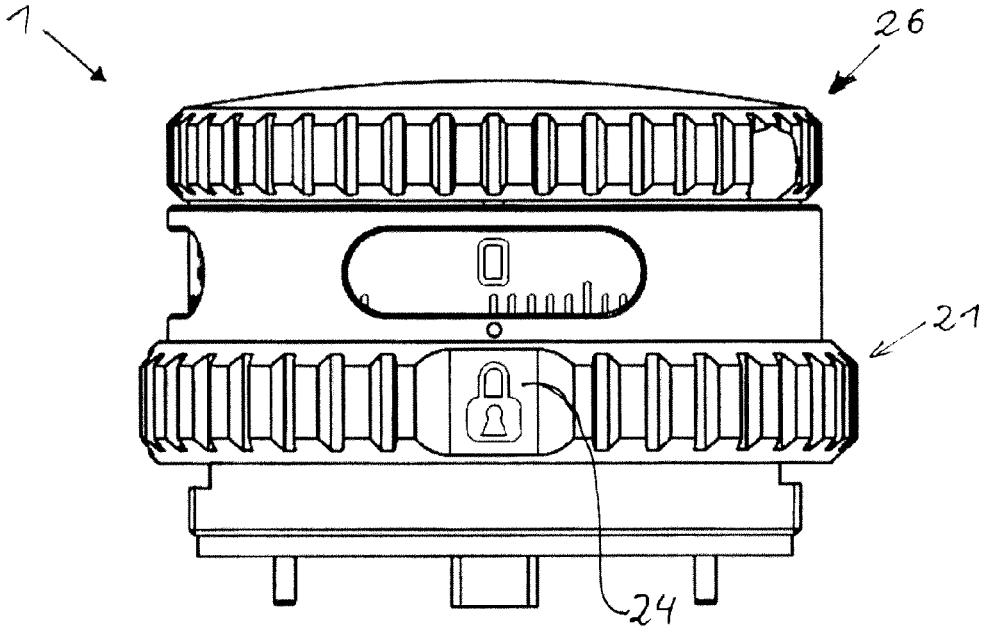
Figure 4B:
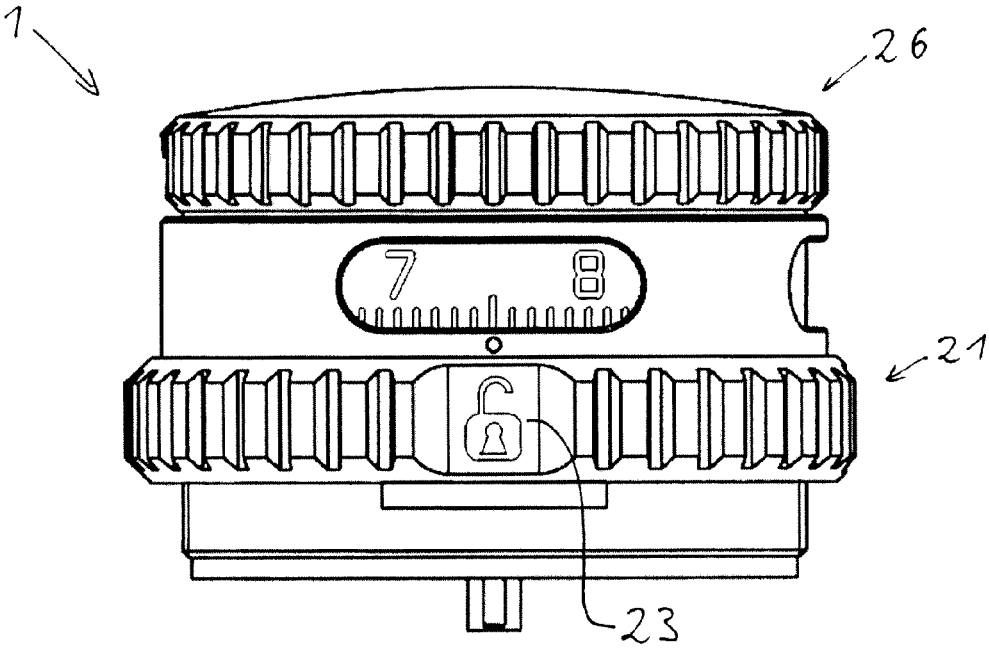
Figure 5A:
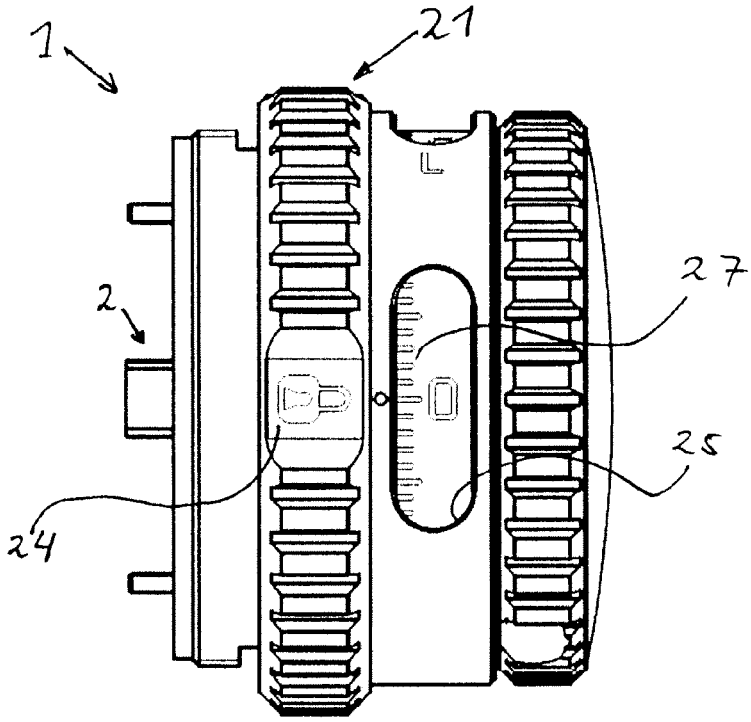
Figure 5B:
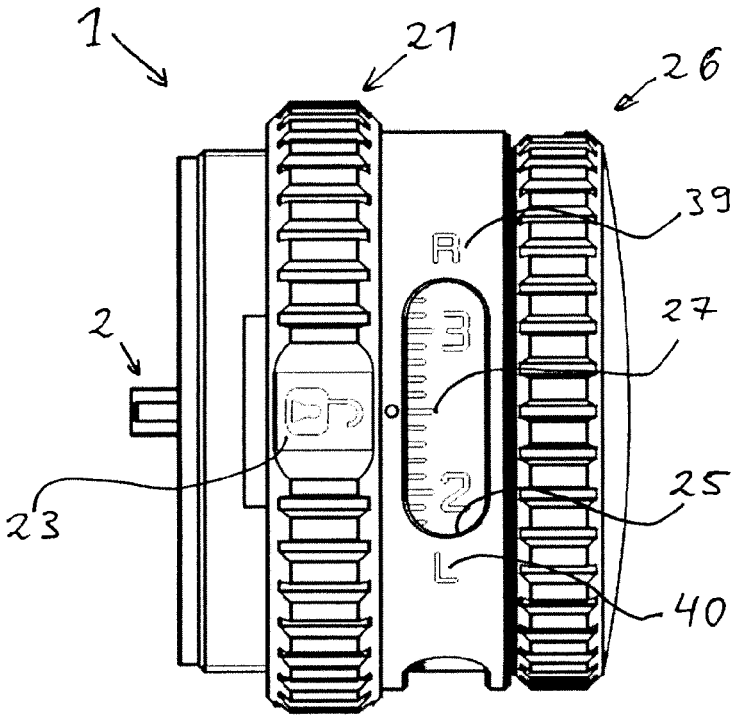

FIG. 1 shows an exploded illustration of a device according to the invention, FIG. 2*a* shows an eyepiece-side overall view of the device according to FIG. 1 in the locked position and FIG. 2*b* shows a sectional illustration of FIG. 2*a*, FIG. 3*a* shows an eyepiece-side overall view of the device according to FIG. 1 in the unlocked position and FIG. 3*b* shows a sectional illustration of FIG. 3*a*, FIG. 4*a* shows an eyepiece-side overall view of a variant of the device according to FIG. 1 with a large control wheel in the locked position and FIG. 4*b* in the unlocked position, FIG. 5*a* shows an eyepiece-side overall view of an embodiment of FIG. 4*a* having suitability for a horizontal adjustment in the locked position and FIG. 5*b* in the unlocked position.

The fast reticle adjustment 1 shown in FIG. 1 has an actuating drive 2 mounted such that it can be displaced in the axial direction for the adjustment of a reticle, not further illustrated, in a telescopic sight, likewise not illustrated. The actuating drive 2 is cylindrical in the exemplary embodiment illustrated, with an upper region of larger diameter and a lower region of smaller diameter and, in the upper region, has an external thread 3 (indicated schematically in the edge region in FIG. 1). The external thread 3 meshes with a corresponding internal thread 5 arranged in a lower cylindrical region of a threaded drive piece 4. The axial adjustment of the actuating drive 2 is illustrated by a double arrow and is effected by a rotational movement of the threaded drive piece 4 with simultaneous securing of the rotation of the actuating drive 2. The threaded drive piece 4 has a click detent, which is formed by a detent pin 6, which rests under preload with a detent pin spring 7 in a detent ring 8 having internal toothing 9. With the aid of a clamping ring 10, the detent ring 8 is screwed via four clamping screws 11 through passage holes in the detent ring 8 against a contact surface 12 molded on the inside, not illustrated in FIG. 1, (see FIGS. 2*b*, 3*b*) in a retaining ring 13, through further passage holes in the contact surface 12 with threaded holes 14 in a mounting base 15, to form a rotationally secured unit. With the clamping ring 10, at the same time a threaded drive piece 4 is also loaded against a leaf spring, not illustrated, which rests in a groove 16. In this way, a play-free rotational bearing unit for the threaded drive piece with simultaneous click detent is formed. Arranged in the retaining ring 13 is a parallel key 17 which meshes with a parallel key groove 18 (here arranged offset for the purpose of better illustration) that is integrally molded on the inner side of a detent wheel 19. On its outer circumference, the detent wheel 19 has a multi-turn movement thread 20, which meshes with a corresponding internal thread 22 integrally molded in a control wheel 21. By rotating the control wheel 21, the movement is transmitted via the movement threads 20, 22 to the detent wheel 19. The detent wheel 19 is prevented from rotating by the rectilinear guide formed by the parallel key 17 in the rotationally secured retaining ring 13 together with the parallel key groove 18 in the detent wheel 19 and, depending on the chosen direction of rotation of the control wheel 21, must move axially upward or downward. In this way, a toothing system 28 integrally molded on the end at the upper edge of the annularly formed detent wheel 19 can be brought into engagement with a corresponding flat toothing system 29 of a latching disk 31 connected to a setting knob 26 by means of four fixing screws 30. In this way, the setting knob 26 is locked against unintended rotational adjustment, and unintended actuation is prevented. In an advantageous refinement, the flat toothing system 29 is integrally molded directly on the setting knob 26. Fabrication is made easier, since the fixing screws 30 and the latching disk 31 can be omitted.

The control wheel 21 has on its circumference, in the region of knurling, an unlocked symbol 23 and a locked symbol 24 arranged offset by 90°. These symbols 23, 24 are assigned two window-like openings 25 in a sleeve-like edge region of the control wheel 21 located above. Each of these openings 25 faces the eyepiece side of the telescopic sight, not illustrated, when in use and can be detected easily by the user by a glance above the eyepiece. Through these openings 25, a scale 27 applied to the lower outer circumference of the setting knob 26 can be seen. The remaining scale area is covered by the sleeve-like edge region of the control wheel 21. In this way, the rotational setting respectively performed with the setting knob 26 can be read simply by the user, and thus the axial position of the actuating drive 2 and therefore also the vertical adjustment of the reticle, not illustrated, can be detected.

For improved tactile detection of the locked and unlocked position, detent torques that can be felt are generated by a ball detent in the end positions arranged offset by 90°. In the mounting base 15, a ball 32 is therefore mounted in a manner preloaded by a spring 33. In the assembled state, the ball 32 is pressed against a lower guide edge 36, mounted in a circumferential groove 35, of the control wheel 21 and, together with two detent grooves 34 not further illustrated in FIG. 1 but arranged offset by 90° in the guide edge 36 of the control wheel 21, effects the ball detent that can be detected by touch.

In FIG. 2*b* of a sectional illustration of the locked position according to FIG. 2*a*, a lower air gap 37 between detent wheel 19 and 36 is illustrated clearly, while the end toothing system 28 is engaged in the flat toothing system 29.

In the sectional illustration FIG. 3*b* of the unlocked position according to FIG. 3*a*, an upper air gap 38 can be seen between the end toothing system 28 and flat toothing system 29, from which the unlocked position results.

In FIG. 4*a*, an overall view of a fast reticle adjustment 1 is illustrated which, for the improved tactile detectability, has a control wheel 21 with a larger external diameter as compared with the setting knob 26. In this way, it is possible for the user to feel whether he is actuating the setting knob 26 with smaller external diameter to adjust the reticle or the control wheel 21 with large diameter for locking or unlocking. The control wheel 21 is located in the locked position 24 in FIG. 4*a* and in the unlocked position 23 in FIG. 4*b*.

In FIG. 5*a*, an eyepiece-side overall view is shown of a fast reticle adjustment 1 in an embodiment fitted on the right on the telescopic sight, not illustrated, having suitability for a horizontal adjustment of the reticle to the left or right. The control wheel 21 with large external diameter is located in the locked position 24. In the window-like opening 25, the scale 27 is shown in a zero position, i.e. no left or right correction of the reticle.

FIG. 5*b* shows the fast reticle adjustment 1 from FIG. 5*a* with control wheel 21 in the unlocked position 23; a set correction of the reticle of 2.5 is visible on the scale 27 in the window-like opening 25. The setting knob 26 should be rotated in the direction of the R mark 39 for a further-reaching correction to the right, and in the direction of the L mark 40 for a correction to the left.

List of Designations

1 Fast reticle adjustment
2 Actuating drive

3 External thread
4 Threaded drive piece
5 Internal thread
6 Detent pin
7 Detent pin spring
8 Detent ring
9 Internal toothing
10 Clamping ring
11 Clamping screw
12 Contact surface
13 Retaining ring
14 Threaded holes
15 Mounting base
16 Groove
17 Parallel key
18 Parallel key groove
19 Detent wheel
20 Movement thread
21 Control wheel
22 Internal thread
23 Symbol (lock open)
24 Symbol (lock closed)
25 Opening
26 Setting knob
27 Scale
28 Toothing system
29 Flat toothing system
30 Fixing screws
31 Detent disk
32 Ball
33 Spring
34 Detent grooves
35 Circumferential groove
36 Guide edge
37 Lower air gap
38 Upper air gap
39 R mark
40 L mark

The invention claimed is:

1. Device (1) for fast reticle adjustment of a sighting device of a telescopic sight in which, with the aid of a rotatably mounted setting knob (26), an actuating drive (2) mounted such that it can be displaced in the axial direction acts on the adjusting unit of the sighting device, characterized in that the setting knob (26) is provided with a safeguard (21) against unintended adjustment that can be rotated through 90°, wherein the safeguard (21) has tactile and visual indicating means (23, 24) for a locked position and an unlocked position of the safeguard.

2. Device (1) for fast reticle adjustment according to claim 1, characterized in that the device (1) is arranged on the top of an intermediate tube connecting the objective and eyepiece of the telescopic sight when in use, and the safeguard (21) is formed by a control wheel (21), which, for the tactile indication in the locked and unlocked positions, arranged offset by 90°, has detent torques that can be felt, and, for the visual indication of the respective control wheel positions, locked and unlocked symbols (24, 23) are arranged offset by 90° on the outer circumference of the said control wheel (21) and, in the respective control wheel position, face the eyepiece side of the telescopic sight.

3. Device (1) for fast reticle adjustment according to claim 2, characterized in that the setting knob (26) has on a circumferential region a scale (27) indicating the axial position of the actuating drive (2), which is enclosed in a concealing manner by a sleeve-like edge region of the control wheel (21).

4. Device (1) for fast reticle adjustment according to claim 3, characterized in that the respectively currently set axial position of the control wheel (21), both in the locked and in the unlocked position of the control wheel setting, is visible on the scale (27) through window-like openings (25) in the sleeve-like edge region of the control wheel (21), wherein one window-like opening (25) is arranged in the region of the locked symbol (24) and a further window-like opening (25) is arranged in the region of the unlocked symbol (23).

5. Device (1) for fast reticle adjustment according to claim 2, characterized in that an axially displaceable annular detent wheel (19) arranged to be fixed rotationally with respect to a mounting base (15) is provided with an end toothing system (28) and a movement thread (20) integrally molded on the outer circumference, which meshes with a corresponding movement thread (22) on the inner circumference of the control wheel (21).

6. Device (1) for fast reticle adjustment according to claim 5, characterized in that the axial displacement of the control wheel (21) is effected by a rotational movement of the control wheel (21) into the locked or unlocked position (24, 23).

7. Device (1) for fast reticle adjustment according to claim 6, characterized in that, in the locked position (24), the end toothing system (28) of the detent wheel (19) can be brought into engagement with a corresponding flat toothing system (29) on the setting knob (26).

8. Device (1) for fast reticle adjustment according to claim 1, characterized in that the setting knob (26) has a click detent (6, 7, 8) for the stepwise adjustment of the actuating drive (2).

9. Device (1) for fast reticle adjustment according to claim 8, characterized in that the click detent (6, 7, 8) is provided on a rotatably mounted threaded drive piece (4) connected to the setting knob (26), wherein, in order to adjust the actuating drive (2), the threaded drive piece (4) has an internal thread (5), in which an external thread (3) of the actuating drive (2) engages.

10. Device (1) for fast reticle adjustment according to claim 9, characterized in that the actuating drive (2) is mounted in a slot-like cutout in the mounting base (15) so as to be fixed against rotation, so that a rotational movement of the threaded drive piece (4) effects an axial displacement of the actuating drive (2).

* * * * *